US011274820B1

(12) United States Patent
Baldwin et al.

(10) Patent No.: US 11,274,820 B1
(45) Date of Patent: Mar. 15, 2022

(54) ELECTRICAL SWITCH LIGHT

(71) Applicants: Jeffrey P. Baldwin, Anthem, AZ (US); John E. Klein, Chandler, AZ (US)

(72) Inventors: Jeffrey P. Baldwin, Anthem, AZ (US); John E. Klein, Chandler, AZ (US)

( * ) Notice: Subject to any disclaimer, the term of this patent is extended or adjusted under 35 U.S.C. 154(b) by 90 days.

(21) Appl. No.: 16/850,939

(22) Filed: Apr. 16, 2020

Related U.S. Application Data

(60) Provisional application No. 62/834,931, filed on Apr. 16, 2019.

(51) Int. Cl.

| | |
|---|---|
| ***F21V 23/04*** | (2006.01) |
| ***F21S 9/02*** | (2006.01) |
| ***F21V 21/02*** | (2006.01) |
| ***H05B 45/10*** | (2020.01) |
| *F21Y 115/10* | (2016.01) |

(52) U.S. Cl.
CPC ..... *F21V 23/04* (2013.01); *F21S 9/02* (2013.01); *F21V 21/02* (2013.01); *H05B 45/10* (2020.01); *F21Y 2115/10* (2016.08)

(58) Field of Classification Search
CPC ..... F21V 23/04; F21V 21/02; H05B 45/10; F21S 9/02
See application file for complete search history.

(56) References Cited

U.S. PATENT DOCUMENTS

2017/0102493 A1* 4/2017 Shivell ..... G01J 5/24

OTHER PUBLICATIONS

Iotty Smart Switch product https://iottysmarthome.com/products/iotty-smart-switch.
Harbor Freight Dimmable LED Super Bright Light Switch: https://www.harborfreight.com/dimmable-led-super-bright-light-switch-64485.html?cid=paid_google%7C%7C%7C64485&utm_source=google&utm_medium=cpc&utm_campaign=&utm_content=&gclid=EAIaIQobChMI8Ynv1PXI6AIVED2tBh3ouwqaEAYYASABEgJH8PD_BwE.

* cited by examiner

*Primary Examiner* — Karabi Guharay
(74) *Attorney, Agent, or Firm* — Booth Udall Fuller, PLC; Kenneth C. Booth

(57) ABSTRACT

An electrical switch light may include a housing with a back surface, the back surface including a mounting portion and recessed portion offset from the mounting portion. A wall coupler may be disposed at the mounting portion and be configured to removably couple with a wall. The at least one may be LED disposed adjacent the recessed portion of the back surface such that the at least one LED is separated from the wall to which the electrical switch light is coupled. At least one second LED may be disposed adjacent the front surface of the housing. A switch may be accessible from an external surface of the housing and electrically coupled to the at least one LED and the at least one second LED to adjust a brightness of the at least one LED and the at least one second LED.

20 Claims, 12 Drawing Sheets

ELECTRICAL SWITCH LIGHT

CLAIM OF PRIORITY

This application claims the benefit, including the filing date, of provisional patent application No. 62/834,931 to Jeffrey P. Baldwin and John E. Klein titled "Switch Light" filed Apr. 16, 2019, the entirety of the disclosure of which is incorporated herein by this reference.

TECHNICAL FIELD

The disclosure relates generally to lights and light switches.

BACKGROUND

An electrical device plate, wall plate, or light cover is a typical device used to cover or prevent undesired access to electrical wires, electrical receptacles, sockets, light switches, and other electrical devices. Conventional electrical wall plates commonly mount to electrical receptacles via connection by fasteners, such as screws, or by a mechanical fit involving interlocking components designed to secure the wall plate to the receptacle. Recently, some electrical wall plates have incorporated lights or other electronic components, thereby offering additional functionality beyond mere prevention of access to the electrical wires and receptacle.

SUMMARY

A need exists for an electrical switch light, switch light, or device that removably mounts to wall or suitable surface for providing dimmable light. According to an aspect of the disclosure an electrical switch light may comprise an opaque housing comprising a front surface and a back surface opposite the front surface. The back surface may comprise a mounting portion and recessed portion offset from the mounting portion. A wall coupler may be disposed at the mounting portion of the back surface and configured to removably couple with a wall. A battery may be disposed within the housing. At least one LED may be disposed at the recessed portion of the back surface of the housing such that the at least one LED is separated from the wall to which the electrical switch light is coupled. The at least one LED may be configured to illuminate the wall when power is supplied through the switch to the at least one LED from the battery. At least one second LED may be disposed at the front surface of the housing. A switch may be accessible from an external surface of the housing and electrically coupled to the battery, the at least one LED, and the at least one second LED, wherein the switch is configured to adjust a brightness of the at least one LED and the at least one second LED.

Particular implementations may comprise one or more of the following features. The housing may further comprise a first depth D1 defined by a distance between, and perpendicular to, the front surface and the mounting portion of the back surface. A second depth D2 may be defined by a distance between, and perpendicular to, the front surface and the recessed portion of the back surface. The first depth D1 may be greater than the second depth D2. The switch may adjust the brightness of the at least one LED and the at least one second LED by an on and off function, a dimming function, or both. A first switch may be configured to turn on and off the at least one LED and the at least one second LED. A second switch may be configured to dim the at least one LED and the at least one second LED. The wall coupler may comprise an adhesive, a fastener such as a threaded fastener, nail, pin, or knob, an opening for receiving a fastener, a magnetic attachment device, or hook or loop fasteners. The at least one second LED may be disposed at the front surface of the housing and comprise a translucent cover.

According to another aspect of the disclosure an electrical switch light may comprise a housing comprising a back surface, wherein the back surface comprises a mounting portion and recessed portion offset from the mounting portion. A wall coupler may be disposed at the mounting portion of the back surface and configured to removably couple with a wall. At least one LED may be disposed adjacent the recessed portion of the back surface of the housing such that the at least one LED is separated from the wall to which the electrical switch light is coupled. At least one second LED may be disposed adjacent the front surface of the housing. A switch may be accessible from an external surface of the housing and electrically coupled to the at least one LED and the at least one second LED. The switch may be configured to adjust a brightness of the at least one LED and the at least one second LED.

Particular implementations may comprise one or more of the following features. The housing may comprise a depth adjacent the recessed portion that is less than a depth of the housing away from the recessed portion. The wall coupler may comprise an adhesive, a fastener such as a threaded fastener, nail, pin, or knob, an opening for receiving a fastener, a magnetic attachment device, or hook or loop fasteners. The at least one LED light may be coupled to, and draw power from, a battery disposed within the housing. The switch adjusts the brightness of the at least one LED and the at least one second LED by an on and off function, a dimming function, or both. The at least one LED comprises an upper LED arranged to illuminate the wall around the housing, and a lower LED arranged to illuminate the ground below the housing. A housing is formed of an opaque material that is non-translucent.

According to another aspect of the disclosure an electrical switch light may include a housing having a back surface, wherein the back surface comprises a mounting portion and recessed portion offset from the mounting portion. A wall coupler may be disposed at the mounting portion of the back surface and configured to removably couple with a wall. At least one LED may be configured to provide light at the recessed portion of the back surface of the housing with the recessed portion of the back surface being separated from the wall to which the electrical switch light is coupled. A switch may be accessible from an external surface of the housing and electrically coupled to the at least one LED, the switch configured to adjust a brightness of the at least one LED.

Particular implementations may comprise one or more of the following features. The housing may comprise a depth adjacent the recessed portion that is less than a depth of the housing away from the recessed portion. The wall coupler may comprise an adhesive, a fastener such as a threaded fastener, nail, pin, or knob, an opening for receiving a fastener, a magnetic attachment device, or hook or loop fasteners. The at least one LED light may be coupled to, and draw power from, a battery disposed within the housing. The at least one LED may comprise an LED rotatably coupled to the housing such that the at least one LED may be angled toward, or away from, the wall. The at least one second LED may be configured to provide light at the front surface of the housing. The at least one LED may comprise a first LED arranged to illuminate the wall around the housing, and a second LED may be arranged to illuminate the ground below the housing. The housing may be formed of an opaque material that is non-translucent.

Aspects and applications of the disclosure presented here are described below in the drawings and detailed description. Unless specifically noted, the words and phrases in the specification and the claims be given their plain, ordinary, and accustomed meaning to those of ordinary skill in the applicable arts. The inventors are fully aware that they can be their own lexicographers if desired. The inventors expressly elect, as their own lexicographers, to use only the plain and ordinary meaning of terms in the specification and claims unless they clearly state otherwise and then further, expressly set forth the "special" definition of that term and explain how it differs from the plain and ordinary meaning. Absent such clear statements of intent to apply a "special" definition, it is the inventors' intent and desire that the simple, plain and ordinary meaning to the terms be applied to the interpretation of the specification and claims.

The inventors are also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventors are fully informed of the standards and application of the special provisions of 35 U.S.C. § 112(f). Thus, the use of the words "function," "means" or "step" in the Detailed Description or Description of the Drawings or claims is not intended to somehow indicate a desire to invoke the special provisions of 35 U.S.C. § 112(f), to define the invention. To the contrary, if the provisions of 35 U.S.C. § 112(f) are sought to be invoked to define the inventions, the claims will specifically and expressly state the exact phrases "means for" or "step for", and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventors not to invoke the provisions of 35 U.S.C. § 112(f). Moreover, even if the provisions of 35 U.S.C. § 112(f) are invoked to define the claimed aspects, it is intended that these aspects not be limited only to the specific structure, material or acts that are described in the preferred implementations or embodiments, but in addition, include any and all structures, materials or acts that perform the claimed function as described in alternative implementations or forms of the disclosure, or that are well known present or later-developed, equivalent structures, material or acts for performing the claimed function The foregoing and other features, advantages and construction of the present disclosure will become more readily apparent and fully appreciated from the following more DETAILED DESCRIPTION of the particular implementations and in conjunction with the accompanying DRAWINGS.

BRIEF DESCRIPTION OF THE DRAWINGS

To further clarify the above and other advantages and features of the present disclosure, some of the implementations will be described in detail, with reference to the following figures, wherein like designations denote like members. It is appreciated that these figures depict only illustrated implementations pertinent to the present disclosure and are therefore not to be considered limiting of inventive scope. As such, the present disclosure will be set forth and explained with additional specificity and detail through the use of the accompanying drawings in which.

DETAILED DESCRIPTION

Figure 1B:
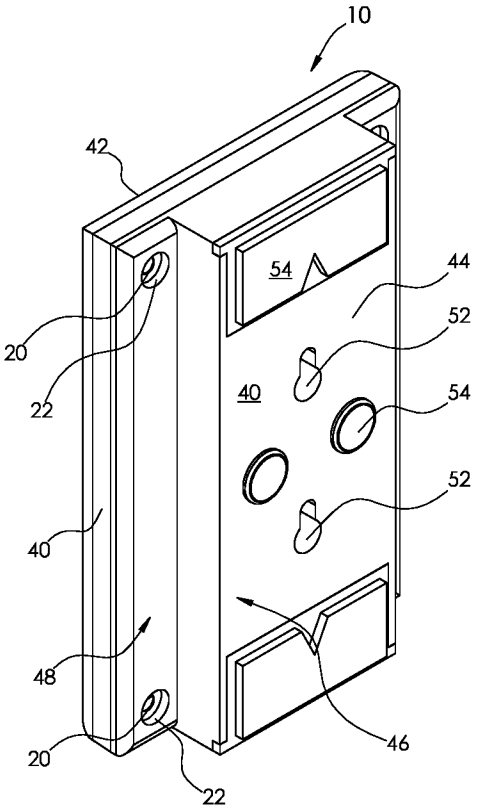
FIGS. 1A and 1B illustrate front and rear perspective views of an implementation of a switch light.

A detailed description of the hereinafter described implementations of the disclosed apparatuses, systems and methods are presented herein by way of exemplification and not limitation with reference to the Figures listed above. Although certain implementations are shown and described in detail, it should be understood that various changes and modifications may be made without departing from the scope of the appended claims. The scope of the present disclosure will in no way be limited to the number of constituting components, the materials thereof, the shapes thereof, the relative arrangement thereof, etc., and are disclosed simply as an example of implementations of the present disclosure.

This disclosure, its aspects and implementations, are not limited to the specific material types, components, methods, or other examples disclosed herein. Many additional material types, components, methods, and procedures known in the art are contemplated for use with particular implementations from this disclosure. Accordingly, for example, although particular implementations are disclosed, such implementations and implementing components may comprise any components, models, types, materials, versions, quantities, and/or the like as is known in the art for such systems and implementing components, consistent with the intended operation.

The word "exemplary," "example," or various forms thereof are used herein to mean serving as an example, instance, or illustration. Any aspect or design described herein as "exemplary" or as an "example" is not necessarily to be construed as preferred or advantageous over other aspects or designs. Furthermore, examples are provided solely for purposes of clarity and understanding and are not meant to limit or restrict the disclosed subject matter or relevant portions of this disclosure in any manner. It is to be appreciated that a myriad of additional or alternate examples of varying scope could have been presented, but have been omitted for purposes of brevity.

While this disclosure includes a number of implementations in many different forms, there is shown in the drawings and will herein be described in detail particular implementations with the understanding that the present disclosure is to be considered as an exemplification of the principles of the disclosed methods and systems, and is not intended to limit the broad aspect of the disclosed concepts to the implementations illustrated.

The present disclosure concerns a switch light, electrical switch light, or device 10. The switch light 10 is a device that may be formed to generally resemble an electrical switch comprising a faceplate, wall plate, or device cover, and may removably couple with a wall, mounting surface, or surface 16, such as ceilings, floors, counters, desks, cabinets, furniture, mirrors, pet spaces, or other surface near, adjacent, or where additional light or lighting is desired. The switch light 10 includes at least one light emitting diode (LED) or light 20 and a switch or light switch 30, which may comprise a rocker, dial, knob, button, lever, toggle, linear dimmer switch, slide, touch pad, or other suitable device. A variety of different implementations of the switch light 10 are discussed below. A person of ordinary skill will understand that the components depicted and discussed are non-limiting examples, and that the contemplated components may be combined with any of the other components in other implementations.

Figure 1A:
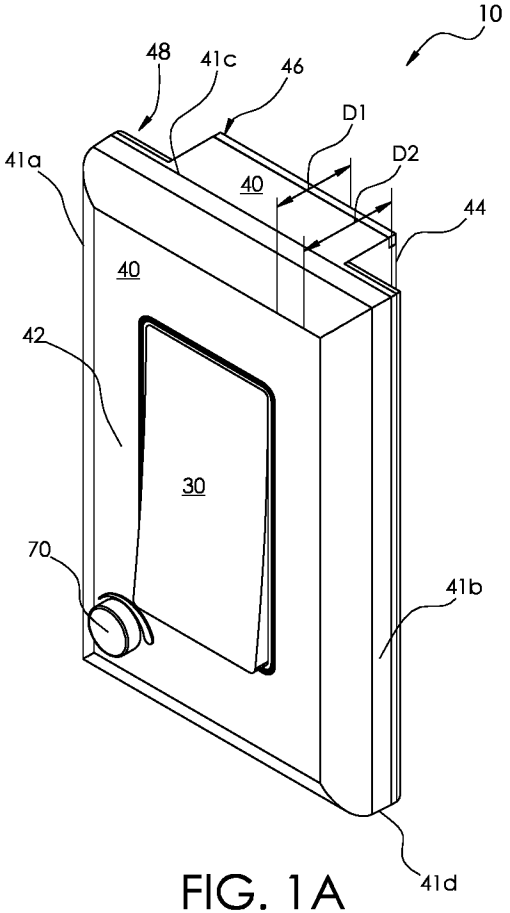
Figure 2A:
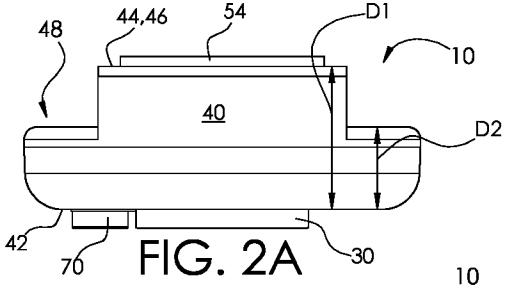
FIGS. 2A-2D illustrate top, front, side, and back profile views, respectively, of the implementation of the electrical switch light from FIGS. 1A and 1B.
Figure 2B:
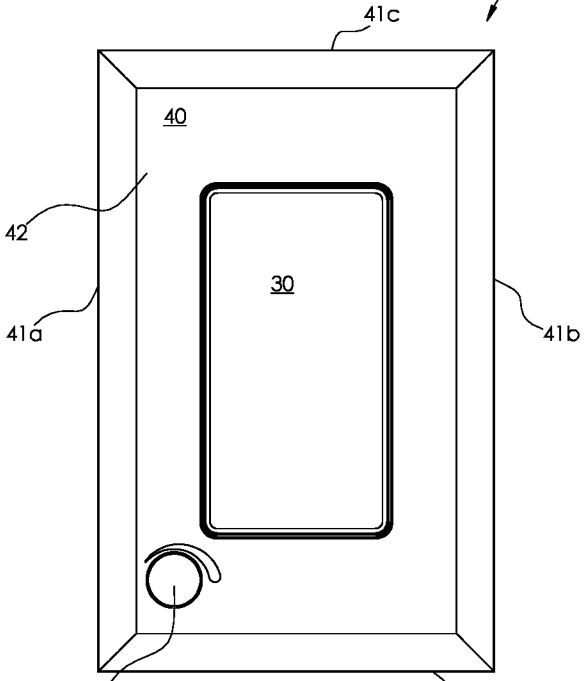
Figure 2C:
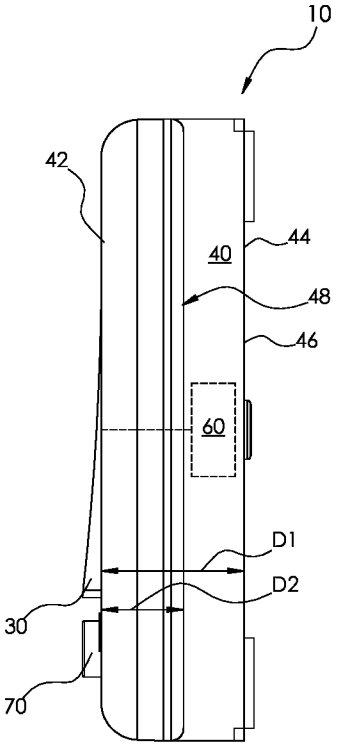
Figure 2D:
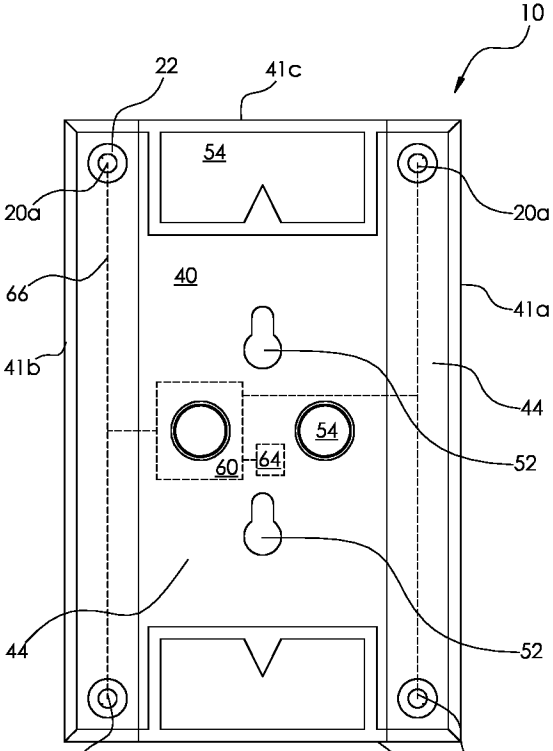
Figure 3B:
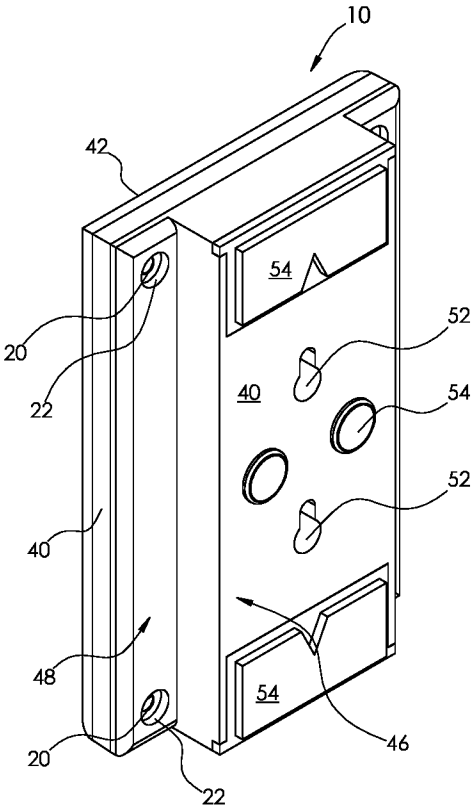
FIGS. 3A and 3B illustrate front and rear perspective views of another implementation of a switch light.
Figure 3A:
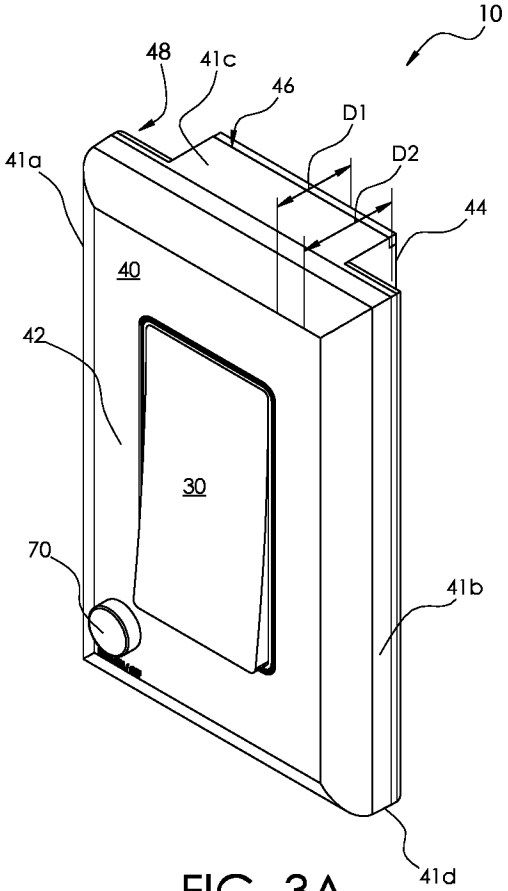
Figure 4D:
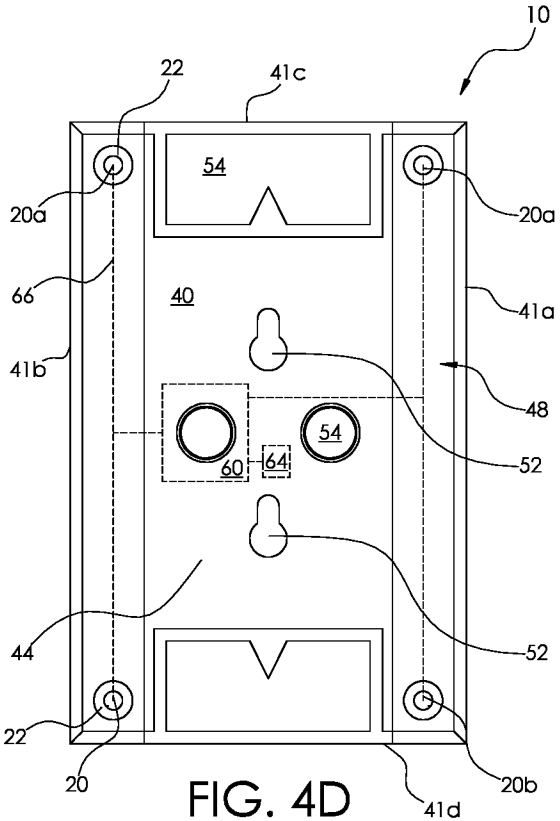
FIGS. 4A-4D illustrate top, front, side, and back profile views, respectively, of the implementation of the electrical switch light shown in FIGS. 3A and 3B.
Figure 4C:
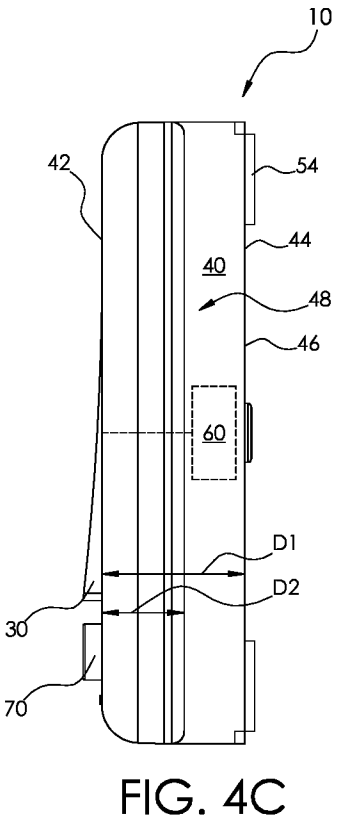
Figure 4A:
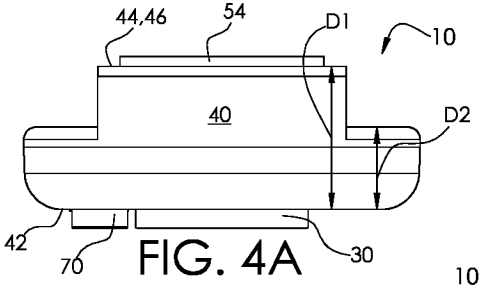
Figure 4B:
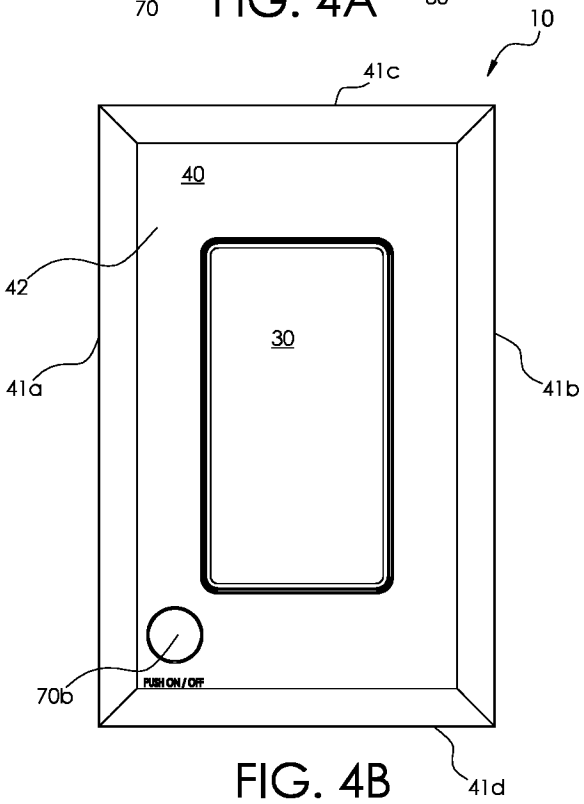

FIGS. 1A-2D illustrate one implementation of the switch light 10. More specifically, FIGS. 1A and 1B illustrate front and rear perspective views, respectively, of the implementation of the electrical switch light 10. FIGS. 2A-2D illustrate top, front, side, and back profile views, respectively, of the implementation of the electrical switch light from FIGS. 1A and 1B. The electrical switch light 10 comprises a housing 40 comprising a front surface 42 and a back surface 44 opposite the front surface 42, wherein the back surface 44 comprises a mounting portion 46 and recessed portion 48 offset from the mounting portion 46. The housing 40 further comprises a first depth D1 defined by a distance between, and perpendicular to, the front surface 42 and the mounting portion 46 of the back surface 44. A second depth D2 defined by a distance between, and perpendicular to, the front surface 42 and the recessed portion 48 of the back surface 44. The first depth D1 is greater than the second depth D2 such that the recessed portion 48 is offset with respect to the back surface 44 and recessed or offset with respect to the wall 16 to which the switch light 10 is mounted. The housing 40 may be made from an opaque material that is not translucent and does not permit or facilitate the passage of light through the housing 40, or from an inner part of the housing, through the housing, to outside the housing to illuminate or light a surrounding area.

At least one wall coupler 52 is disposed at, positioned on, or accessible at, a surface of the housing 40, a surface of the switch light 10 or housing 40, that allows the switch light 10 to be coupled to a wall 16. The wall coupler 52 may comprise an adhesive, a fastener such as a threaded fastener, nail, stud, pin, or knob, an opening for receiving a fastener, a magnetic attachment device, or hook or loop fasteners. The wall coupler 52 may be positioned on, or accessible at, a surface of the housing 40 that is oriented towards, or facing, the housing 40. For example, the wall coupler 52 may be coupled to, positioned on, or accessible from, the mounting portion 46 of the back surface 44 and configured to removably couple the housing 40 or switch light 10 with the wall 16. FIG. 1B shows a non-limiting example of two vertically separated or spaced apart wall couplers 52, but in other instances could be horizontally separated or spaced apart, or comprise any other desirable number or arrangement. In some instances, having two wall couplers 52 can help prevent the switch light 10 from twisting or rotating about a single wall coupler 52. FIG. 1B shows a non-limiting implementation of the wall couplers 52 formed, configured, or arranged as openings or receiving slots for releasably coupling the switch light 10 to the wall 16. In other instances, the wall couplers 52 could be protrusions that extend from the switch light 10 and are received into openings in the wall 16, or into a frame, mounting bracket, receiving element, or other suitable device.

In some instances, a pad, mounting tape, or buffer 54 made of a compliant material, foam, or other suitable material may be disposed at, positioned on, or accessible at, a back surface 44 or mounting portion 46 of the housing 40. The pad 54 may work together with the wall coupler 52 to allow the switch light 10 to be held against the wall 16 without scuffing, marking, or damaging the wall 16.

A battery, energy unit, or self-contained power source 60 may be disposed within the housing 40 and coupled to the light switch 30 and the at least one LED 20, by electrical wiring or electrical connection 66, in order to power the LED 20 and provide light when the light switch 30 is engaged. The battery 60 can convert chemical energy to electrical energy, thereby allowing the LED 20 and the switch light 10 to operate without being coupled to an electrical receptacle, socket fixture, or common duplex-type electrical receptacle device like a conventional wall mounted switch or night light that draws power from an electrical outlet. By drawing power from battery 60, the switch light may be releasably, moveably, or temporarily coupled to the wall 16, and easily moved again to a new or different location, simply by adjusting mechanical connections of the wall coupler 52, and without adjusting or changing any electrical connections or wiring, such as with an electrical receptacle. As such, the switch light 10 may be easily and efficiently moved and relocated without the more difficult, labor intensive, time consuming, and expensive effort required of moving a wired switch or wired light.

The light switch 30 is shown as being disposed at, or accessible from, an exterior surface of the housing 40, the switch 30 being coupled to, and configured to activate or deactivate, the lights 20. As illustrated, the light switch 30 may be a rocker switch, or any other suitable switch, such as a dial, knob, lever, linear dimmer switch, or touch pad. The light switch 30 provides power to the LEDs 20 when flipped or moved in one direction or to a first position, and stops supplying power to the LEDs 20 when flipped or moved in the other direction or to a second position. For example, a switch light 30 could be positioned at a convenient height, accessibly to a user, in a dark closet (shed, or other space) and could easily provide light in the closet by having the wall coupler 52 releasably coupled to the wall 16, and providing light from LEDs 20 powered by battery 60 when activated by switch 30. As such, light could be provided without installing two separate devices, a conventional light and a conventional switch, each of which would need to be wired to the building's or structure's electrical wiring. Connecting to the building's electrical wiring would require intervention that is more invasive, costly, and time consuming than using switch light 10, by needing to cut into building surfaces (such as walls and ceilings), and running new wiring or connecting into existing wiring. On the other hand, the time, expense, and invasive changes required by a conventional wired solution can all be avoided by instead using the switch light 10, which provides light at a desired location in a non-invasive way, by having the switch light 10 releasably coupled to a wall 16, and does so with a natural look, the switch light 10 resembling a conventional switch and wall plate.

In other instances, the switch light 10 may comprise the switch 30 being coupled to a transmitter 64 configured to be communicatively coupled to a remote device, such as a light or fan, that can be controlled remotely, wirelessly, or at a distance. In such instances, the switch light 10 may be positioned at a height or position easily accessible to a user, and the switch 30 may control the remotely positioned device, such as the light or fan. Further, the LEDs 20 of the switch light 10 may or may not be turned on or off by the switch 30, the switch 30 controlling the remote device, and the LEDs 20 of the switch light 10 being controlled by a dimmer switch 70. For example, a switch light 30 could be positioned at a convenient height in a dark closet (shed, or other space) and be coupled to an overhead light through the transmitter 64. The remote device could be controlled (even dimmed) and turned on and off by the switch 30, without needing an invasive, expensive, or time-consuming installation of a conventional switch. Additionally, the switch light 10 could be easily found by a user, such as in a dark closet, by being illuminated by the LEDs 20, which would allow the switch light 10 to be easily located by a user (even if in a dark space). Once found, the switch 30 could then be activated to turn on the remote light or device. In such instances, the LEDs 20 could remain on, drawing small quantities of energy from the battery 60, and could be separately controlled and dimmed by the separate dimmer switch 70, and not by switch 30.

In any event, the switch light 10 may comprise the at least one LED 20 disposed at the recessed portion 48 of the back surface 44 of the housing 40 such that the at least one LED 20 is separated from the wall 16 to which the electrical switch light 10 is coupled. As such, the at least one LED 20 may be configured to illuminate the wall 16 when power from the battery 60 is supplied to the at least one LED 20. As illustrated in FIGS. 1A-2D, the recessed portions 48 may be formed as elongated channels, carveouts, or offsets that extend along opposing sides or edges 41 of the housing 40, such as vertically extending along left side, first side, left edge, or first edge 41*a* and the right side, second side, right edge, or second edge 41*b* of the housing 40. One or more, or at least one, LED light 20 may be disposed within the recessed portion 48 and extend along the left edge 41*a* and right edge 41*b* of back surface 44. The LEDs 20 may be disposed at any desirable position within the recessed portions 48, including upper LEDs or lights 20*a* being disposed at or adjacent an upper or top portion of the housing 40, such as top side 41*c*. Similarly, lower LEDs or lights 20*b* may be disposed at or adjacent a bottom or lower portion of the housing 40, such as bottom side 41*d*.

Figure 10:
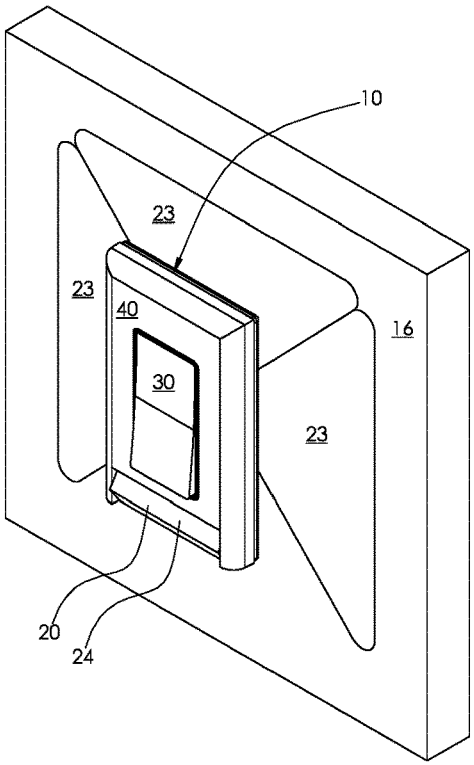

The LEDs 20 may be positioned at, or aligned with, LED openings 22 in the housing 40, and allow the light to extend away from the LEDs 20 and the housing 40 to illuminate the wall 16 and the space around the switch light 10. In some instances, at least one of the LEDs 20 may be a rotating or positionable LED 24 rotatably coupled to the housing 40 such that the LED 24 may be angled toward, or away from, the wall 16 or toward or away from the ground as desired, and as is shown in FIG. 10. Moreover, the LED lights 20 may be located in any desirable location, layout, configuration, or shape on, at, or accessible from, any surface of the switch light 30, including one or more of the sides.

A dimmer switch 70 may be disposed at, on, adjacent, or be accessible from, an external surface of the housing 40 and formed as a rocker, dial, knob, lever, toggle, linear dimmer switch, slide, touch pad, or other suitable device. The dimmer switch 70 may be electrically coupled to the at least one LED 20 and the battery 60, the dimmer switch 70 configured to adjust the brightness of the LEDs 20, such as between a minimum brightness level and a maximum brightness level. The minimum brightness level may include no brightness or the LEDs 20 being turned off, such as the dimming going to no luminosity, or shutting off the LEDs 20 completely. While the dimmer switch 70 is shown at the front surface 42 of the housing 40, the dimmer switch 70 may be located on any surface of the switch light 30 or any surface of the housing 40, such as the sides 41 or the back surface 44. The dimmer switch 70 shown in FIGS. 1A-2D is illustrated as a rotating knob 70*a*, where the brightness level of the LEDs 20 increases when the rotating knob 70*a* is rotated in one direction (such as clockwise), and the brightness level decreases when the rotating knob is rotated in the opposite direction, or a second direction (such as counter-clockwise).

While FIGS. 1A-2D and the other FIGs. show the dimmer switch 70 as separate from the light switch 30, in some instances the functionality of both dimmer switch 70 and light switch 30 could be integrated into a single switch, rocker, dial, knob, lever, toggle, linear dimmer switch, slide, touch pad, or other suitable device to control LEDs 20, both with respect to the LEDs being on or off, as well as adjustably dimming their brightness.

In any event, the witch light 10 can provide a low cost, easily installed, non-invasive lighting solution to easily and conveniently improve lighting in low light areas, such as closets, sheds, or other similar spaces.

FIGS. 3A-4D, similar to FIGS. 1A-2D, illustrate another implementation of the switch light 10, where similar features comprise similar element or reference numbers. More specifically, FIGS. 3A and 3B, similar to FIGS. 1A-2D, illustrate front and rear perspective views, respectively, of the implementation of the electrical switch light 10. FIGS. 3A-3D, similar to FIGS. 2A-2D, illustrate top, front, side, and back profile views, respectively, of the implementation of the electrical switch light from FIGS. 3A and 3B.

Figure 5:
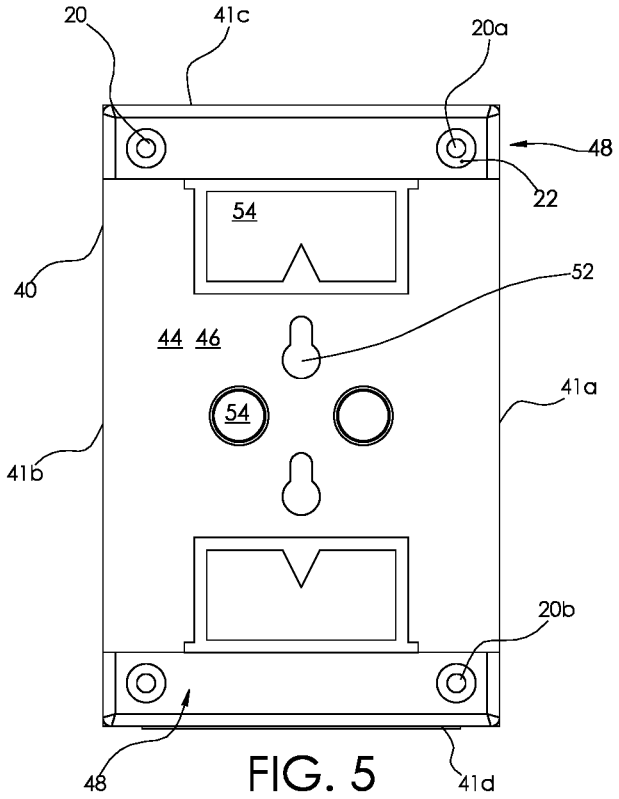
FIG. 5 illustrates a back profile view of another implementation of a switch light.

FIGS. 3A-4D differ from FIGS. 1A-2D in that the dimmer switch 70 of FIGS. 3A-4D may comprise a push button or button 70*b*, as illustrated in FIGS. 4-5. The push button 70*b* may be pressed to adjust the brightness level of the lights or LEDs 20. The brightness level may alternate between two levels of brightness, with one level being dimmer than the other. One of these levels (e.g. the level being dimmer than the other) may be where no light is emitted or the LEDs 20 are off. Alternatively, the brightness level may cycle through three or more levels, with the brightness changing each time the push button is pressed. In some embodiments, the brightness level may cycle through a continuous gradient of brightness levels, with the brightness changing as the button 70*b* is pressed. While the dimmer switch 70 is shown as a push button 70*b* disposed at the front surface 42 of the housing 40, the push button 70*b* may be located on any surface of the switch light 30 or any surface of the housing 40, such as the sides 41 or the back surface 44.

FIG. 5 illustrates a back profile view of another implementation of a switch light 10 in which the recessed portions 48 may be formed as elongated channels, carveouts, or offsets that extend horizontally along opposing top side 41*c* and bottom side 41*d* or edges of the housing 40. One or more, or at least one, LED light 20 may be disposed within the recessed portion 48 and extend along the top side 41*c* and the bottom side 41*d* of the housing 40 or of the back surface 44 of the housing 40.

Figure 6:
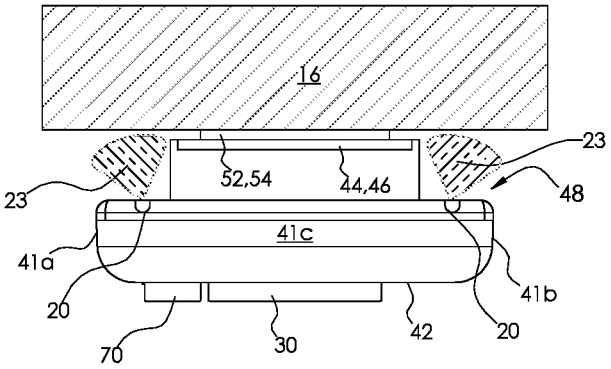
FIG. 6 illustrates a top plan view of an implementation of a switch light coupled to a wall.

FIG. 6 illustrates a top plan view of an implementation of the switch light 10, such as that pictured in one or more of FIGS. 1A-4D, coupled to the wall 16. FIG. 6 further illustrates light or illumination 23 from LEDs 20 that may extend, or be projected, from a surface of the housing 40 (such as back surface 44, and more particularly the recessed portion 48) that is oriented towards, or faces, the wall 16.

Figure 7:
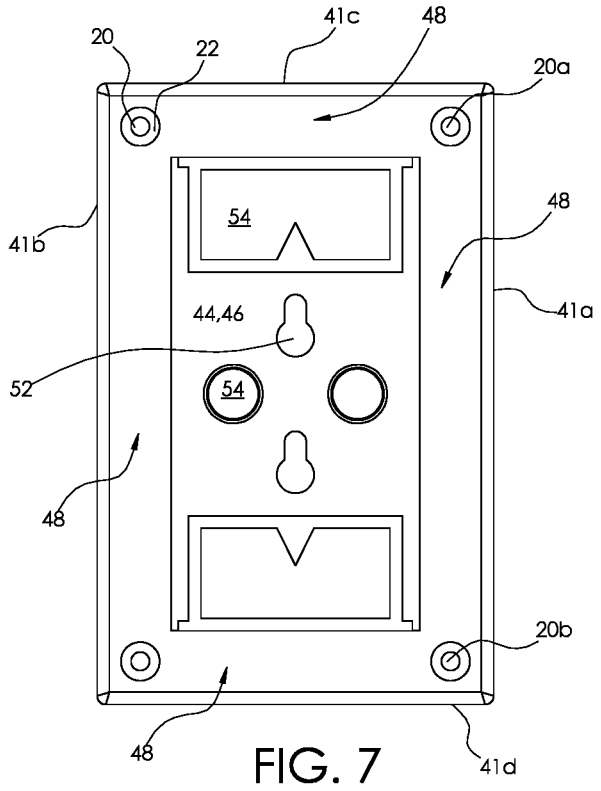
FIG. 7 illustrates a back profile view of another implementation of a switch light.
Figure 8:
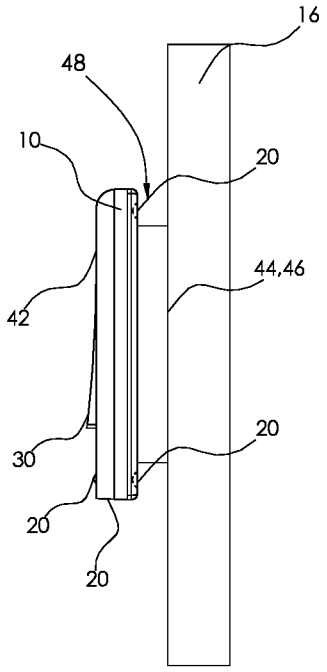
FIG. 8 illustrates a side profile views of the implementation of the electrical switch light from FIG. 7.
Figure 9:
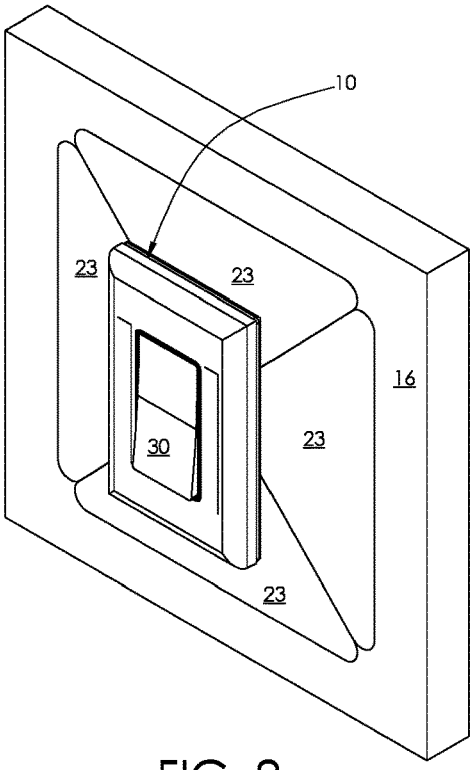
FIGS. 9 and 10 illustrate perspective views of implementations of a switch light mounted to a wall.

FIGS. 7-9 illustrate an instance in which the recessed portions 48 may be formed as elongated channels, carveouts, or offsets that extend along a plurality of opposing sides or edges of the housing 40, including four or more sides, or all sides, of the switch light 10. FIG. 7 shows a profile view of the back surface 44. FIG. 8 provides a side or profile view of the switch light 10 coupled to the wall 16. FIG. 9 provides a perspective view of the front surface 42, right side 41*b*, and top side 41*c* of the switch light 10 as the switch light 10 is coupled to the wall 16, with light 23 being projected from LEDs 20 from the back surface 44 of the housing 40 onto the wall 22.

More specifically, FIGS. 7-9 illustrate an instance in which the recessed portions 48 may be disposed or positioned both along the left and right sides of the housing 40 in a vertical direction, as well as along the upper and lower sides of the housing 40 in a horizontal direction. Taken together, the recessed portions 48 may extend around an entire perimeter of the back surface 44 of the housing 40. One or more, or at least one, LED light 20 may be disposed within the recessed portion 48 and extend along the left edge 41*a*, the right edge 41*b*, the top edge 41*c* and the bottom edge 41*d* of the housing 40 or of the back surface 44 of the housing 40.

In other implementations, one or more of the at least one LED lights 20 may be located on any one or more sides or edges 41 of housing 40, as shown, e.g., in FIG. 8. As such, although many FIGs. show lighting elements 20 on the back surface 44 of the switch light 10 illuminating the wall 16 behind it, the lighting elements 20 may also be placed on, at, or near the sides 41 of the housing 40. FIG. 9, further shows the directions the light 23 may shine or emanate from the back side 44 of the switch light 10.

FIG. 10 illustrates perspective view of the switch light 10 mounted to a wall 16, similar to the view shown in FIG. 9. FIG. 10 differs from FIG. 9 in that FIG. 10 illustrates an instance in which at least one of the LEDs 20 is a rotating LED 24, rotatably coupled to the housing 40 such that at least one rotating LED 24 of the at least one LEDs 20 may be angled toward, or away from, the wall 16. As such, of the at least one LEDs 20 may comprise a first LED 20 arranged to illuminate the wall 16 around the housing 40, and a second or rotating or moveable LED 24 arranged to illuminate the ground below the housing 40, the light 23 of the LED 24 being directed away from the wall 16. Additionally, the rotating or moveable LED 24 may be positioned, disposed, or placed at, near, or an any of the sides 41*a*-41*d* of the housing 40, and be angled toward the wall 16.

The presence of rotating LED 24 may be accomplished mechanically, by reflecting light 23 that is angled toward (or away from) the wall 16 or ground, and may also be done by adding an additional bank of LED lights 20, 24 that may be switched either with the main switch 30 or with an alternate switch on the housing 40. The inclusion of lighting elements 20 illuminating the wall 16 around the switch light 10 in addition to directional lighting elements 24 illuminating outward from the wall, such as toward the ground below the switch light 10, may be useful in many situations, such as increasing visibility of the ground, for storage, walking, or both.

FIGS. 11A-14 illustrate instances or embodiments of a switch light 10 similar to those shown in FIGS. 1A-10, where like features are indicated with like element number or reference numbers. FIGS. 11A-14 are similar to FIGS. 1A-10 by including instances or embodiments of a switch light 10 comprising at least one LED 20 that are formed as at least one LED 20*a*, 20*b* disposed at the recessed portion 48 of the back surface 44 of the housing 40 such that the at least one LEDs 20*a*, 20*b* are separated from the wall 16 to which the electrical switch light 10 is coupled. The at least one LEDs 20*a*, 20*b* are configured to illuminate the wall 16 when power is supplied through the switch 30 to the at least one LEDs 20*a*, 20*b* from the battery 60. FIGS. 11A-14 differ from FIGS. 1A-10 by further illustrating at least one second LED or light 20*c* disposed at the front surface 42 of the housing 40. One or more of the lights 20, including all of the lights or LEDs 20*a*, 20*b*, and 20*c* can be controlled by the switch 30, a dimmer switch 70, or both. In some instances, the switch 30 adjusts the brightness of the at least one LEDs 20*a*, 20*b* at the back surface 44 as well as the at least one second LEDs 20*c* at the front surface 42 by an on and off function, a dimming function, or both. As noted above, in some instances the dimming function may adjust the brightness to a level of no brightness or the LEDs 20 being turned off.

Figure 11B:
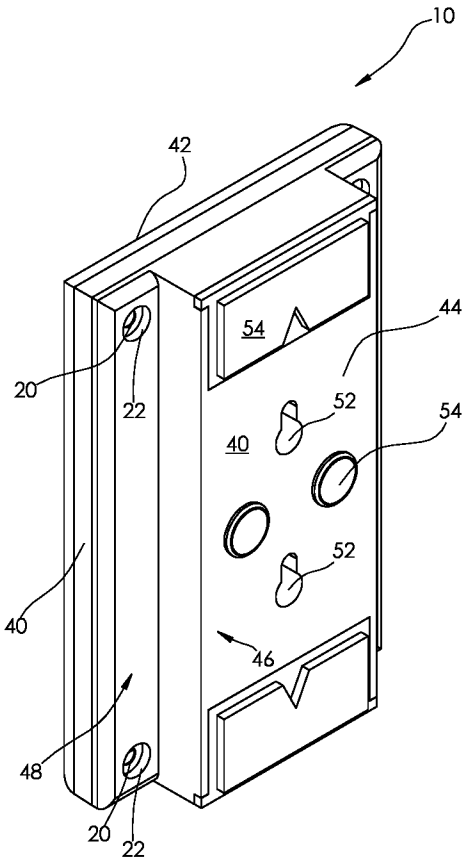
FIGS. 11A and 11B illustrate front and rear perspective views of an implementation of a switch light.
Figure 11A:
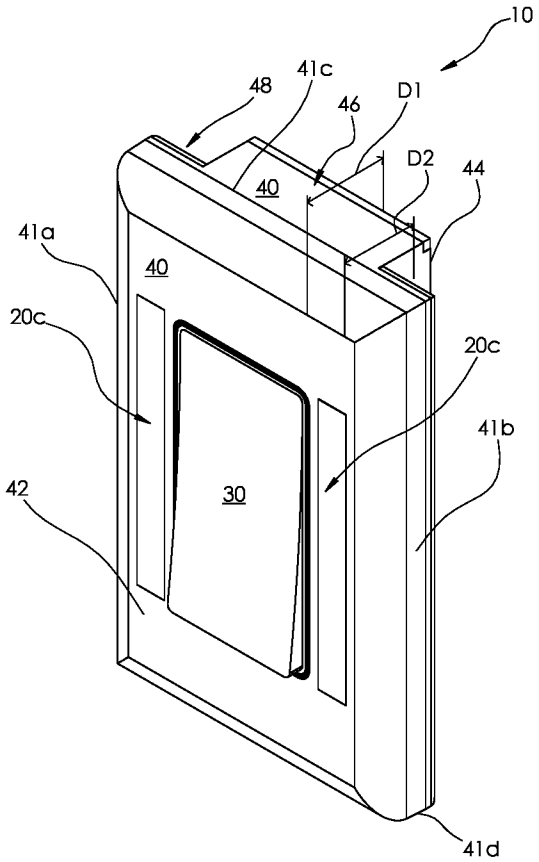
Figure 12A:
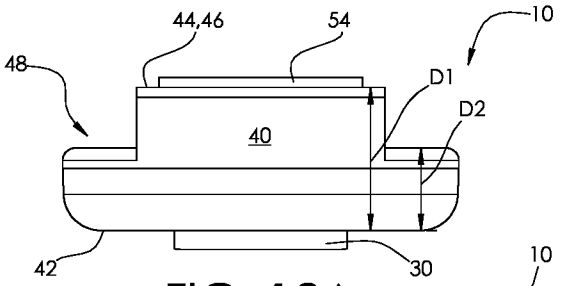
FIGS. 12A-12D illustrate top, front, side, and back profile views, respectively, of the implementation of the electrical switch light from FIGS. 11A and 11B.
Figure 12B:
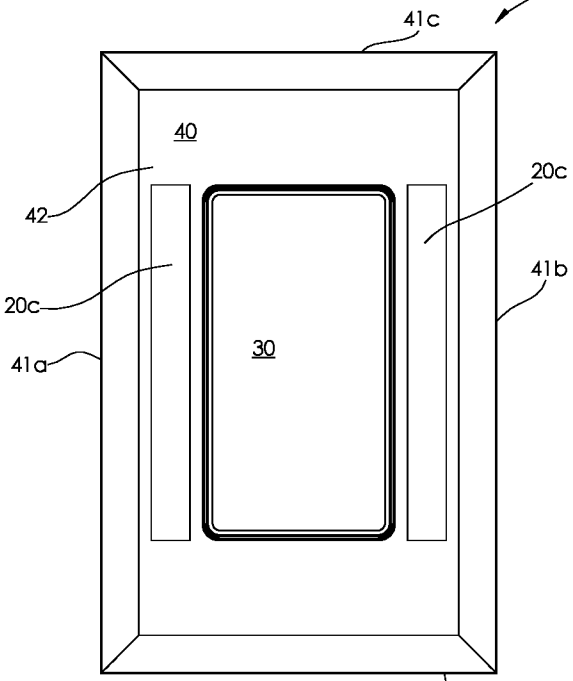
Figure 12C:
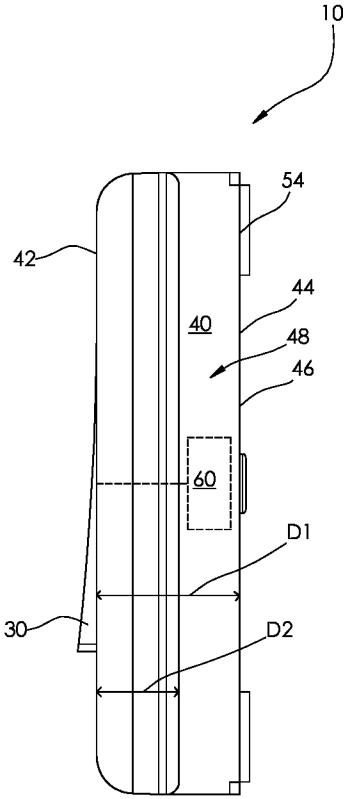
Figure 12D:
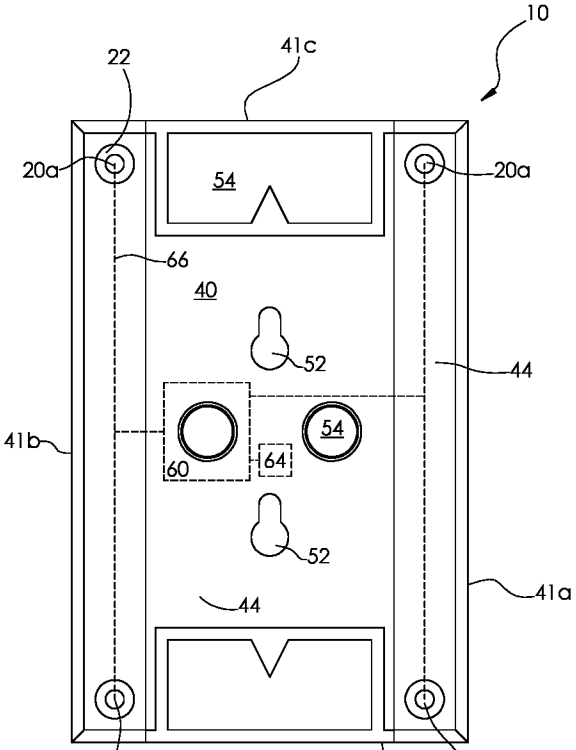

FIGS. 11A and 11B illustrate a front perspective view and a rear perspective view, respectively, similar to the views of FIGS. 1A and 1B. FIGS. 11A and 11B differ from FIGS. 1A and 1B by omitting a discrete dimmer switch 70, although a person of ordinary skill in the art (POSA) will appreciate that in interest of brevity, every combination or permutation of features has not been shown or described specifically, but may be included according in different combinations or permutations according to a desired function, purpose, or design. FIGS. 11A and 11B differ from FIGS. 1A and 1B by including at least one front light(s) or LED 20*c*. For ease of description, the back upper light 20*a* and back lower light 20*b* may be referred to as the at least one light or LED 20*a*, 20*b* while the at least one front light(s) or LED 20*c* may be referred to as the at least one second light or LED 20*c*.

The position or location of the lights or LEDs 20, including back upper lights 20*a*, back lower lights 20*b* and front lights 20*c* are described herein as: (i) being disposed at the recessed portion 48 of the back surface 44 of the housing 40 and being disposed at the front surface 42 of the housing 40, (ii) being disposed adjacent the recessed portion 48 of the back surface 44 of the housing 40 and being disposed adjacent the front surface 42 of the housing 40, and (iii) being configured to provide light at the recessed portion 48 of the back surface 44 of the housing 40 and being configured to provide light at the front surface 42 of the housing 40.

When the lights or LEDs 20 are disposed at a surface of the housing 40, the term "at" may include not only the physical position of the LED 20 itself being immediately adjacent the surface of the housing 40, but may also include a physical position of the LED 20 being adjacent, near, or slightly offset from the housing 40 or the surface of the housing 40. The LED 20 disposed at a surface of the housing 40 includes the LED 20 positioned or disposed on a circuit board within the housing 40 and configured to provide light or illumination 23 from, or at, the surface of the housing 40. The LEDs 20 may provide light 23, such as from an opening in the housing 40 like openings 22 (whether the openings are on or through the front surface 42 or the back surface 44 of the housing 40). The LEDs 20 may provide light 23 through a translucent material covering the opening in the opaque housing 40 from which, or at which, the light 23 from the LEDs 20 passes to outside the housing 40 and outside the electrical switch light 10 to provide light or illumination 23 to the surrounding environment. Accordingly, the lights or LEDs 22 may comprise a translucent cover, such as a translucent cover at a surface of the housing 40, as shown e.g., with the front lights 20*c* in FIG. 11A.

FIGS. 12A-12D illustrate top, front, side, and back plan/profile views of the switch light 10, respectively, similar to the views of FIGS. 2A-2D. FIGS. 12A-12D differ from FIGS. 2A-2D by omitting a discrete dimmer switch 70, and by including at least one front light or LED 20*c*.

Figure 13:
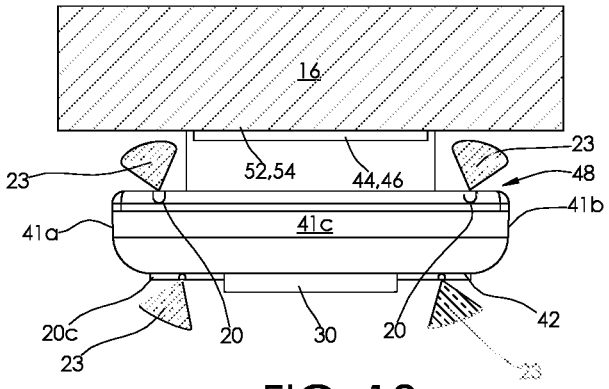
FIG. 13 illustrates a top plan view of an implementation of a switch light coupled to a wall.

FIG. 13 illustrates a top plan view of the switch light 10, similar to the view shown in FIG. 6. FIG. 13 differs from FIG. 6 by omitting a discrete dimmer switch 70, and by including at least one front light or LED 20*c*. FIG. 13, continuing from FIGS. 11A-12D, shows the switch light 10 mounted to the wall 16, with light 23 from LEDs 20 coming from both the front surface 42 and the back surface 44 of the housing 40 to provide illumination 23 at the wall 16 and in the surrounding ambient space or environment.

Figure 14:
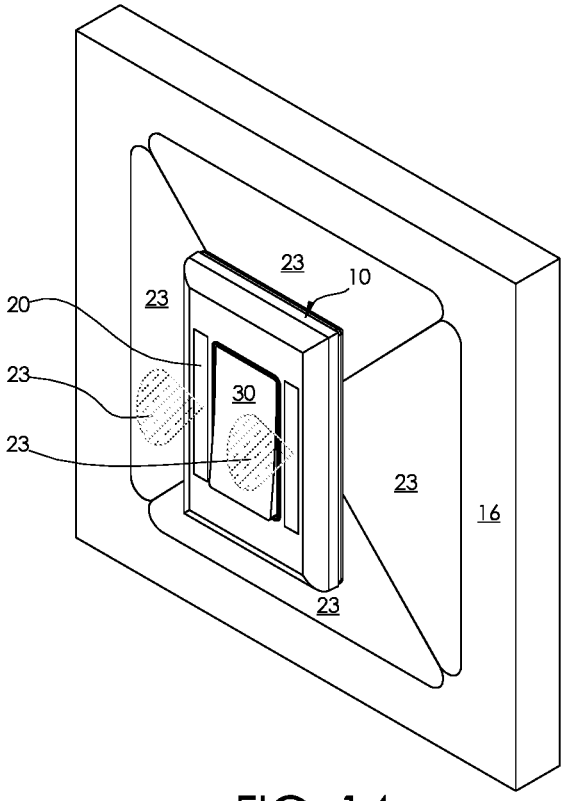
FIG. 14 illustrates perspective views of implementations of a switch light mounted to a wall.

FIG. 14, continuing from FIG. 13, illustrates a perspective view of the switch light 10 mounted to the wall 16. FIG. 14 is similar to FIG. 9, but differs from FIG. 9 by omitting a discrete dimmer switch 70, and by including at least one front light or LED 20*c*.

It will be understood that implementations of the switch light are not limited to the specific components disclosed herein, as virtually any components consistent with the intended operation of various switch lights may be utilized. Accordingly, for example, it should be understood that, while the drawings and accompanying text show and describe particular switch light implementations, any such implementation may comprise any shape, size, style, type, model, version, class, grade, measurement, concentration, material, weight, quantity, and/or the like consistent with the intended operation of switch lights.

The concepts disclosed herein are not limited to the specific electrical switch lights shown herein. For example, it is specifically contemplated that the components included in particular electrical switch lights may be formed of any of many different types of materials or combinations that can readily be formed into shaped objects and that are consistent with the intended operation of the electrical switch lights with dimmer switches. For example, the components may be formed of: rubbers (synthetic and/or natural) and/or other like materials; glasses (such as fiberglass), carbon-fiber, aramid-fiber, any combination therefore, and/or other like materials; elastomers and/or other like materials; polymers such as thermoplastics (such as ABS, fluoropolymers, polyacetal, polyamide, polycarbonate, polyethylene, polysulfone, and/or the like, thermosets (such as epoxy, phenolic resin, polyimide, polyurethane, and/or the like), and/or other like materials; plastics and/or other like materials; composites and/or other like materials; metals, such as zinc, magnesium, titanium, copper, iron, steel, carbon steel, alloy steel, tool steel, stainless steel, spring steel, aluminum, and/or other like materials; and/or any combination of the foregoing.

Furthermore, electrical switch lights may be manufactured separately and then assembled together, or any or all of the components may be manufactured simultaneously and integrally joined with one another. Manufacture of these components separately or simultaneously, as understood by those of ordinary skill in the art, may involve 3-D printing, extrusion, pultrusion, vacuum forming, injection molding, blow molding, resin transfer molding, casting, forging, cold rolling, milling, drilling, reaming, turning, grinding, stamping, cutting, bending, welding, soldering, hardening, riveting, punching, plating, and/or the like. If any of the components are manufactured separately, they may then be coupled or removably coupled with one another in any manner, such as with adhesive, a weld, a fastener, any combination thereof, and/or the like for example, depending on, among other considerations, the particular material(s) forming the components.

In places where the description above refers to particular electrical switch lights implementations, it should be readily apparent that a number of modifications may be made without departing from the spirit thereof and that these implementations may be applied to other implementations disclosed or undisclosed. The presently disclosed electrical switch lights are, therefore, to be considered in all respects as illustrative and not restrictive.

What is claimed is:

1. An electrical switch light, comprising:

an opaque housing comprising a front surface and a back surface opposite the front surface, wherein the back surface comprises a mounting portion and recessed portion offset from the mounting portion;

a wall coupler disposed at the mounting portion of the back surface and configured to removably couple with a wall;

a battery disposed within the housing;

at least one LED disposed at the recessed portion of the back surface of the housing such that the at least one LED is separated from the wall to which the electrical switch light is coupled, the at least one LED configured to illuminate the wall when power is supplied through the switch to the at least one LED from the battery;

at least one second LED disposed at the front surface of the housing; and a switch accessible from an external surface of the housing and electrically coupled to the battery, the at least one LED, and the at least one second LED, wherein the switch is configured to adjust a brightness of the at least one LED and the at least one second LED.

2. The electrical switch light of claim 1, wherein the housing further comprises:

a first depth D1 defined by a distance between, and perpendicular to, the front surface and the mounting portion of the back surface; and a second depth D2 defined by a distance between, and perpendicular to, the front surface and the recessed portion of the back surface;

wherein the first depth D1 is greater than the second depth D2.

3. The electrical switch light of claim 1, wherein the switch adjusts the brightness of the at least one LED and the at least one second LED by an on and off function, a dimming function, or both.

4. The electrical switch light of claim 3, wherein the switch further comprises:

a first switch configured to turn on and off the at least one LED and the at least one second LED; and a second switch configured to dim the at least one LED and the at least one second LED.

5. The electrical switch light of claim 1, wherein the wall coupler comprises at least one of an adhesive, a threaded fastener, a nail, a pin, a knob, an opening for receiving a fastener, a magnetic attachment device, and a hook or loop fastener.

6. The electrical switch light of claim 1, wherein the at least one second LED disposed at the front surface of the housing comprises a translucent cover.

7. An electrical switch light, comprising:

a housing comprising a back surface, wherein the back surface comprises a mounting portion and recessed portion offset from the mounting portion;

a wall coupler disposed at the mounting portion of the back surface and configured to removably couple with a wall;

at least one LED disposed adjacent the recessed portion of the back surface of the housing such that the at least one LED is separated from the wall to which the electrical switch light is coupled;

at least one second LED disposed adjacent the front surface of the housing; and a switch accessible from an external surface of the housing and electrically coupled to the at least one LED and the at least one second LED, wherein the switch is configured to adjust a brightness of the at least one LED and the at least one second LED.

8. The electrical switch light of claim 7, wherein the housing comprises a depth adjacent the recessed portion that is less than a depth of the housing away from the recessed portion.

9. The electrical switch light of claim 7, wherein the wall coupler comprises at least one of an adhesive, a threaded fastener, a nail, a pin, a knob, an opening for receiving a fastener, a magnetic attachment device, and a hook or loop fastener.

10. The electrical switch light of claim 7, wherein the at least one LED light is coupled to, and draws power from, a battery disposed within the housing.

11. The electrical switch light of claim 7, wherein the switch adjusts the brightness of the at least one LED and the at least one second LED by an on and off function, a dimming function, or both.

12. The electrical switch light of claim 7, wherein the at least one LED comprises:

an upper LED arranged to illuminate the wall around the housing; and a lower LED arranged to illuminate the ground below the housing.

13. The electrical switch light of claim 7, wherein a housing is formed of an opaque material that is non-translucent.

14. An electrical switch light, comprising:

a housing comprising a back surface, wherein the back surface comprises a mounting portion and recessed portion offset from the mounting portion;

a wall coupler disposed at the mounting portion of the back surface and configured to removably couple with a wall;

at least one LED configured to provide light at the recessed portion of the back surface of the housing with the recessed portion of the back surface being separated from the wall to which the electrical switch light is coupled; and a switch accessible from an external surface of the housing and electrically coupled to the at least one LED, the switch configured to adjust a brightness of the at least one LED.

15. The electrical switch light of claim 14, wherein the housing comprises a depth adjacent the recessed portion that is less than a depth of the housing away from the recessed portion.

16. The electrical switch light of claim 14, wherein:

the wall coupler comprises at least one of an adhesive, a threaded fastener, a nail, a pin, a knob, an opening for receiving a fastener, a magnetic attachment device, and a hook or loop fastener; and the at least one LED light is coupled to, and draws power from, a battery disposed within the housing.

17. The electrical switch light of claim 14, wherein the at least one LED comprises an LED rotatably coupled to the housing such that the at least one LED may be angled toward, or away from, the wall.

18. The electrical switch light of claim 14, further comprising at least one second LED configured to provide light at the front surface of the housing.

19. The electrical switch light of claim 14, wherein the at least one LED comprises:

a first LED arranged to illuminate the wall around the housing; and a second LED arranged to illuminate the ground below the housing.

20. The electrical switch light of claim 14, wherein a housing is formed of an opaque material that is non-translucent.

* * * * *